US009242159B1

(12) United States Patent
Lacoste et al.

(10) Patent No.: US 9,242,159 B1
(45) Date of Patent: Jan. 26, 2016

(54) BASEBALL ARM TRAINER

(71) Applicants: Gregg Lacoste, Covington, LA (US); Chris Yeager, Mandeville, LA (US)

(72) Inventors: Gregg Lacoste, Covington, LA (US); Chris Yeager, Mandeville, LA (US)

( * ) Notice: Subject to any disclaimer, the term of this patent is extended or adjusted under 35 U.S.C. 154(b) by 9 days.

(21) Appl. No.: 13/747,856

(22) Filed: Jan. 23, 2013

(51) Int. Cl.
*A63B 69/00* (2006.01)
*A63B 21/00* (2006.01)

(52) U.S. Cl.
CPC ..... *A63B 69/0002* (2013.01); *A63B 21/1434* (2013.01); *A63B 21/1442* (2013.01); *A63B 2069/0006* (2013.01); *A63B 2069/0008* (2013.01)

(58) Field of Classification Search
CPC ..... A63B 69/0002; A63B 69/0071; A63B 69/0059; A63B 69/3608; A63B 2069/0008; A63B 2069/0006; A63B 2243/0037; A63B 2243/0004; A63B 23/14
USPC ..... 473/422, 451, 450, 458, 464, 212–217; D21/694, 753, 721
See application file for complete search history.

(56) References Cited

U.S. PATENT DOCUMENTS

| | | | | |
|---|---|---|---|---|
| 475,432 | A | 5/1892 | Blades | |
| 2,134,451 | A | 10/1938 | Mogren | |
| 2,893,736 | A | 7/1959 | Tesi | |
| 3,618,942 | A | 11/1971 | Bates | |
| 3,870,317 | A | 3/1975 | Wilson | |
| 4,134,589 | A | 1/1979 | Arena | |
| 4,225,133 | A * | 9/1980 | Kiray | 473/457 |
| 4,544,155 | A * | 10/1985 | Wallenbrock et al. | 473/213 |
| 5,009,420 | A | 4/1991 | Martelli | |
| 5,048,836 | A | 9/1991 | Bellagamba | |
| 5,114,142 | A | 5/1992 | Gillespie et al. | |
| 5,154,416 | A | 10/1992 | Smull et al. | |
| 5,188,366 | A | 2/1993 | Dorotinsky et al. | |
| 5,269,512 | A | 12/1993 | Crowson et al. | |
| 5,348,292 | A * | 9/1994 | Norman, Sr. | 473/438 |
| 5,358,250 | A | 10/1994 | Spencer | |
| 5,586,962 | A | 12/1996 | Hallmark | |
| 5,704,856 | A | 1/1998 | Morse | |
| 5,803,822 | A | 9/1998 | Pursell | |
| 5,924,933 | A | 7/1999 | Pacheco | |
| 5,938,548 | A | 8/1999 | Upshaw | |
| 6,120,418 | A | 9/2000 | Plough | |

(Continued)

FOREIGN PATENT DOCUMENTS

| | | |
|---|---|---|
| GB | 281.171 | 12/1927 |
| GB | 1.500.322 | 2/1978 |

*Primary Examiner* — Mitra Aryanpour
(74) *Attorney, Agent, or Firm* — Michael I. Kroll

(57) ABSTRACT

A method of training a baseball player with a sports training apparatus having a fastener removably affixable to a defined portion of a user; a generally stationary batter's wall with vertically spaced attachment points; an elastic connector connecting the fastener and the attachment points; a belt strap having a front hip fastener, a rear hip fastener, and a forward fastener; an anchor having an anchoring device for anchoring into a ground surface and an anchor fastener as the attachment; an elastic connector connecting the rear hip fastener with an attachment point on the wall; a bat having a barrel; and a bat barrel cuff strapped to a barrel of a bat held by the user, with an elastic connector connecting the bat barrel cuff to an attachment point approximately bat barrel height directly behind the user. Any one of several exercises can be performed by connecting at least one elastic connector between at least one fastener and at least one attachment point, followed by performing a physical maneuver with the defined portion of the user to which the fastener is affixed.

5 Claims, 16 Drawing Sheets

"BATTER'S ARM TRAINER" AND "INFIELDER'S ARM TRAINER"

(56) References Cited

U.S. PATENT DOCUMENTS

| | | | | |
|---|---|---|---|---|
| 6,413,176 | B1 | 7/2002 | Martinez | |
| 6,514,163 | B2 | 2/2003 | Burns | |
| 6,612,845 | B1 * | 9/2003 | Macri et al. | 434/247 |
| 6,773,366 | B2 | 8/2004 | Gray | |
| 6,786,855 | B2 | 9/2004 | Prichard | |
| 6,984,184 | B2 | 1/2006 | Gray | |
| 7,314,437 | B2 * | 1/2008 | Frappier | 482/124 |
| 7,381,140 | B1 * | 6/2008 | Stanisic | 473/464 |
| 7,438,653 | B2 * | 10/2008 | Anderson | 473/458 |
| 7,651,450 | B2 * | 1/2010 | Wehrell | 482/124 |
| 7,758,436 | B2 * | 7/2010 | Reynolds | 473/207 |
| 7,874,970 | B2 | 1/2011 | Glisan | |
| 8,052,546 | B1 * | 11/2011 | Nagel et al. | 473/450 |
| 8,337,371 | B2 * | 12/2012 | Vollmer, Jr. | 482/126 |
| 8,512,171 | B1 * | 8/2013 | Minotti | 473/451 |
| 2008/0102971 | A1 | 5/2008 | Anderson | |
| 2008/0167144 | A1 | 7/2008 | Brunst | |
| 2009/0098945 | A1 | 4/2009 | George | |
| 2010/0035706 | A1 | 2/2010 | Sanchez | |
| 2010/0125011 | A1 | 5/2010 | Capps | |
| 2011/0039640 | A1 | 2/2011 | Principe | |
| 2011/0212797 | A1 * | 9/2011 | Adkins | 473/451 |

* cited by examiner

BATTER'S BELT LEVERAGE TRAINER TO ANCHOR

BATTER'S BELT LEVERAGE TRAINER TO ANCHOR

BATTER'S BELT LEVERAGE TRAINER TO ANCHOR

BATTER'S BELT LEVERAGE TRAINER TO BATTER'S WALL

BATTER'S BELT STRIDE TRAINER

BATTER'S BELT STRIDE TRAINER

BATTER'S WALL "HANDS BACK TRAINER"

BATTER'S WALL "HANDS BACK TRAINER"

"BATTER'S ARM TRAINER" AND "INFIELDER'S ARM TRAINER"

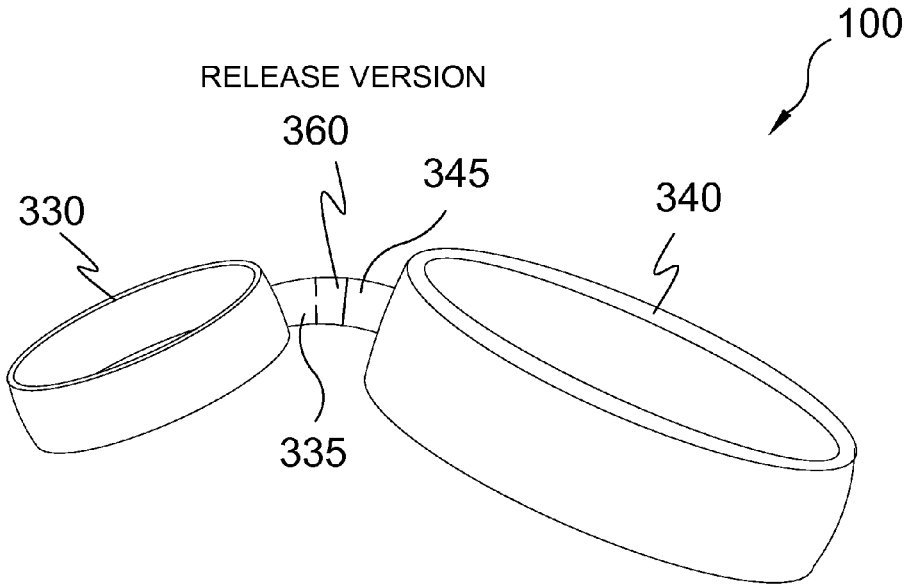
"BATTER'S ARM TRAINER" AND "INFIELDER'S ARM TRAINER"
FIG. 5B2
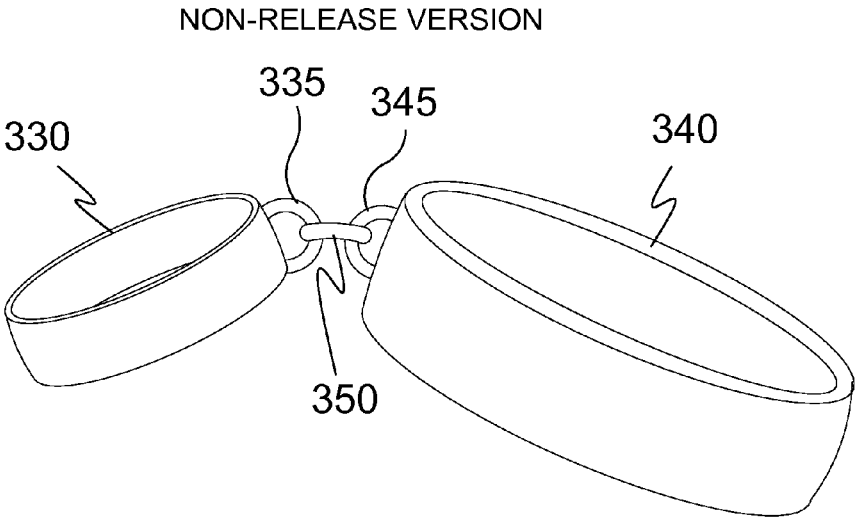
"BATTER'S ARM TRAINER" AND "INFIELDER'S ARM TRAINER"
FIG. 5B1

"BATTER'S ARM TRAINER" AND "INFIELDER'S ARM TRAINER"

"BATTER'S ARM TRAINER" AND "INFIELDER'S ARM TRAINER"

BATTER'S WALL BARREL LOAD TRAINER

BATTER'S WALL BARREL LOAD TRAINER

BATTER'S WALL THROW TRAINER

BASEBALL ARM TRAINER

BACKGROUND OF THE INVENTION

1. Related Applications

This application is a Continuation-In-Part of U.S. patent application Ser. No. 12/875,770 having a filing date of 3 Sep. 2010 and U.S. patent application Ser. No. 13/720,013 having a filing date of 19 Dec. 2012.

Please incorporate by reference all information in said patent applications into this continuation-in-part application.

2. Field of the Invention

The present invention relates generally to sports equipment and, more specifically, to a sports training apparatus comprising portable elastic members and/or plastic components or other attachments forming resistive member applied to a particular dynamic or fixed movement to enhance performance of said dynamic or fixed movement.

3. Description of the Prior Art

There are other training devices designed for sports. Typical of these is U.S. Pat. No. 475,432 issued to Blades on May 24, 1892.

Another patent was issued to Gillespie on May 19, 1992 as U.S. Pat. No. 5,114,142. Yet another U.S. Pat. No. 5,154,416 was issued to Smull et al. on Oct. 13, 1992 and still yet another was issued on Jan. 6, 1998 to Morse as U.S. Pat. No. 5,704,856.

Another patent was issued to Upshaw on Aug. 17, 1999 as U.S. Pat. No. 5,938,548. Yet another U.S. Pat. No. 6,413,176 was issued to Martinez on Jul. 2, 2002. Another was issued to Kevin C. Burns on Feb. 4, 2003 as U.S. Pat. No. 6,514,163 and still yet another was issued on Aug. 10, 2004 to Gray as U.S. Pat. No. 6,773,366.

Another patent was issued to Gray on Jan. 10, 2006 as U.S. Pat. No. 6,984,184. Yet another U.S. Patent No. 2009/0098945 was issued to George on Apr. 16, 2009. Another was published to Davis on Dec. 1, 1927 as U.K. Patent No. GB281,171 and still yet another was published on Feb. 8, 1978 to Oppenheimer as U.K. Patent No. GB1500322.

U.S. Pat. No. 5,114,142

Inventor: Gordon A. Gillespie et al

Issued: May 19, 1992

A training device for baseball or softball hitters is provided having a firm belt for encircling the chest of a hitter, and a separate firm belt for encircling the upper portion of the lead arm of the hitter, with the two belts being firmly secured together so as to bind the hitter's upper lead arm tightly to his side while leaving his forearm generally free for movement throughout an entire swing of the bat. Using this training device, when the hitter begins to swing at a pitched ball, the upper portion of his lead arm and elbow becomes "locked in" close to his side, and remains so locked throughout the entire swing. The training device thus promotes desirable hip action and "tophand action" produced by the swinging motion of the hitter's body, thus generating more power in the swing.

U.S. Pat. No. 5,154,416

Inventor: Joseph C. Smull et al

Issued: Oct. 13, 1992

A bottom hand swing developer for a batter is provided and consists of a harness worn on the upper torso of the batter and a restraining member of predetermined length disposed between the harness and a wrist of a top hand of the batter. The top hand will be restricted from dominating the batting swing, while the bottom hand will participate equally with the top hand when the batter swings the bat to hit the ball.

U.S. Pat. No. 5,704,856

Inventor: Bruce A. Morse

Issued: Jan. 6, 1998

A device for training batters to properly shift weight to the back leg at the beginning of a swing and to shift weight to the front leg during a swing when striking the ball in baseball and similar games. The device includes a first strap for fastening to the leading leg just above the knee and a second strap for fastening to the leading wrist, "leading" being the side towards a pitcher. An elongated member connects the two straps and comprises an elastic portion and an adjustable length portion, which includes a separable buckle so that the elongated member can be separated without removing either strap. In use, straps are emplaced on the knee and wrist and the adjustable length portion is adjusted to be taut but not stretched with the batter in the "ready" position. At the start of a swing, the hands move back, stretching the elongated member to encourage weight movement to the back leg. When the forward swing and forward stride begin, the elongated member will be stretched forwardly to encourage weight shift to the forward leg. Proper weight shift will provide maximum batting stroke power.

U.S. Pat. No. 5,938,548

Inventor: Willie Shaw

Issued: Aug. 17, 1999

A simplified training device for improving the batting skill of a batter in baseball has a pair of arm cuffs adapted to encircle the arms of the batter at a location above the elbows thereof, and a pair of elongate flexible tie straps which are coextensive with each other and which extend between and are connected to the arm cuffs. The device is so constituted that the tie straps can be easily adjusted as to their effective lengths. When the tie straps are taut, they positively limit the maximum space between the arm cuffs at the time that the batter's arms are in a raised, retracted position. The straps are flexible and capable of collapsing movement to enable the arm cuffs to approach each other as the batter's arms are swung from the raised, retracted position toward the extended, ball-striking position.

U.S. Pat. No. 6,413,176

Inventor: Tommy Martinez

Issued: Jul. 2, 2002

A wrist worn bat swing aid (10) includes a closed band (12) constructed to fit around a wrist of a leading arm, the closed band having a first fastener portion (13) of a detachable fastener. The aid (10) further includes an open band (14) coupled to the closed band for placement around a wrist of a guide arm, wherein the closed band has a second fastener portion (18) of the detachable fastener for mating with the first fastener portion. Optionally, a second closed band (20) is coupled to the first closed band, wherein the second closed band is formed to fit around a finger of the leading arm.

U.S. Pat. No. 6,514,163

Inventor: Kevan C. Burns

Issued: Feb. 4, 2003

A batting aid which is designed to improve a baseball player's batting swing and to strengthen his leading batting arm comprises an upper arm cuff attached to the upper portion of the leading arm of a person preparing to swing a bat, a wrist cuff attached to the wrist of the batter's arm, and an elastic strap connecting them. The wrist cuff has a thumb strap to hold the wrist cuff in place. The wrist cuff and the upper arm cuff are connected by an elastic strap such that, when the batter's leading arm is flexed the elastic strap is slack, and when the arm is extended, the elastic strap becomes taught and provides a resisting force against the further extension of the leading arm.

U.S. Pat. No. 6,773,366

Inventor: Jonathan D. Gray

Issued: Aug. 10, 2004

An apparatus for building muscle memory to develop a more rapid baseball swing and avoid casting of the hands and bat during the swing. Such apparatus includes a first attachment member connectable to an upper arm and a second attachment member connectable to an opposing forearm interposed by an elongated tether to be aligned along a forearm upon initially entering into a hitter's stance. A method for using such apparatus is also disclosed herein.

U.S. Pat. No. 6,984,184

Inventor: Jonathan D. Gray

Issued: Jan. 10, 2006

An apparatus for building muscle memory to develop a more rapid baseball swing and avoid casting of the hands and bat during the swing. Such apparatus includes a first attachment member connectable to an upper arm and a second attachment member connectable to an opposing forearm interposed by an elongated tether to be aligned along a forearm upon initially entering into a hitter's stance. A method for using such apparatus is also disclosed herein.

U.S. Patent Number 2009/0098945

Inventor: Nathaniel L. George

Issued: Apr. 16, 2009

The present invention relates to devices more specifically for use in sports training in the fields of baseball, softball, golf, tennis, and other sports requiring control of, and the accuracy of a swing of the wrists, the positioning and follow through of the foots, and the positioning of the body when developing its precision and its reactions to moving objects. Important to the concept is the location of the pivot point or "center of action" associated with the muscular control developed when using this device. By attaching the resistance bands at the waist, proper control and muscle development relating to improved performance is accomplished.

U.K. Patent Number GB281,171

Inventor: Henry Kirk Brown Davis

Published: Dec. 1, 1927

A device for holding the arms of a player making golf strokes comprises means encircling the arms of the player and connected by a member extending freely in front of the body of the player. Two loops 10, 11, FIG. 1, of leather, webbing, elastic, or other material, are adjusted to grip the arms of the player by the movement of slides 13, 14. The loops are connected by a hook 12 and eye 15, and the distance between the arms is adjustable by a buckle 16 on the loop 11. In a modification FIG. 7, adjustable loops 213 are connected by a rigid member 210 to which they are each removably attached at one end by press-buttons 219. In a further modification, FIG. 4, loops 113 are removably attached to members 110 carried by internally threaded tubes 119, 122. The tubes are connected by a third tube 123 secured to the tube 122 and slidable within the tube 119, to which however it may be secured by a spring-pressed detent 125 releasable by a member 129.

U.K. Patent Number GB1500322

Inventor: Jess Oppenheimer

Published: Feb. 8, 1978

Apparatus for use in practising the swinging of a hand-hold instrument, swing motions comprises a support member 10 adjustably mounted on a base 12 and fixable in a desired position by pins 22. Three shafts 36, 38 and 40 are interconnected and are each rotatable about their respective longitudinal axes and may be extended or retracted along their respective longitudinal axes. The shaft 40 is connected at one end to a device 160 such as a golf club, tennis racket, baseball bat or cricket bat. Shaft 36 is connected to a bracket 32 which is provided with rollers or gears for movable engagement with the support member 10 and which may be locked in a desired position on said support member. Motion-sensing apparatus and actuating apparatus may be interconnected with each of the shafts to monitor and/or control the swing motion of the instrument 160 being manipulated by the user. A head engaging member 92 attached to a member 88 supported by a column 84 on a base 96 may be used to assist the user in maintaining a correct head position. A control system 150 may be used to monitor the motion-sensing apparatus and to control the actuating apparatus according to signals produced by the motionsensing apparatus and/or data from sources external to the system. The sensing, actuating and control apparatus may comprise equipment known in the art. Any of the shafts 36, 38 and 40 may be locked to prevent them from rotating about their respective longitudinal axis and/or extending or retracting along said respective axis in order to impose a desired limitation on the movement of the device 160. Power may be applied to a shaft 18 to position the support member 10.

While these training devices may be suitable for the purposes for which they were designed, they would not be as suitable for the purposes of the present invention, as hereinafter described.

SUMMARY OF THE PRESENT INVENTION

A primary object of the present invention is to provide sports training apparatus comprising portable elastic members forming resistive member applied to a particular dynamic or fixed movement to enhance performance of said dynamic or fixed movement Another object of the present invention is to provide a training device having at least one elastic member mountable between a stationary devices and a user whereby the elastic member provides resistance during execution of a dynamic movement.

Yet another object of the present invention is to provide a training device having a plurality of elastic members mountable between stationary devices and a user whereby the elastic members provide resistance during execution of a dynamic movement.

Still yet another object of the present invention is to provide a training device having at least one member taken from the group of elastic, plastic, magnetic and Velcro® mountable to a user between a first body part and a second body part that can act as a fixed device or dynamic device with a release and non-release version to simulate a "take" swing/throw or a full swing/throw.

Another object of the present invention is to provide a training device having a plurality of elastic members mountable to a user between a plurality of desired body parts and a plurality of differing body parts.

Yet another object of the present invention is to provide a training device having an elastic member releasably fastened to a stationary point and releasably fastened approximate the distal end of a bat providing resistance while "taking a swing" of said bat thereby keeping the bat from dropping too soon to enhance performance of a dynamic movement.

Still yet another object of the present invention is to provide a training device having an elastic member releasably mounted to a stationary point and releasablly mounted to a belt strap so that a user overcomes a force to maintain a center of balance during execution of a desired movement in swinging a bat.

Additional objects of the present invention will appear as the description proceeds.

The present invention overcomes the shortcomings of the prior art by isolating each part of the body that is kinetically linked in a sequential manner to all other parts of the body in an effort to maximize the force and power that can be generated when hitting a baseball.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 3A:
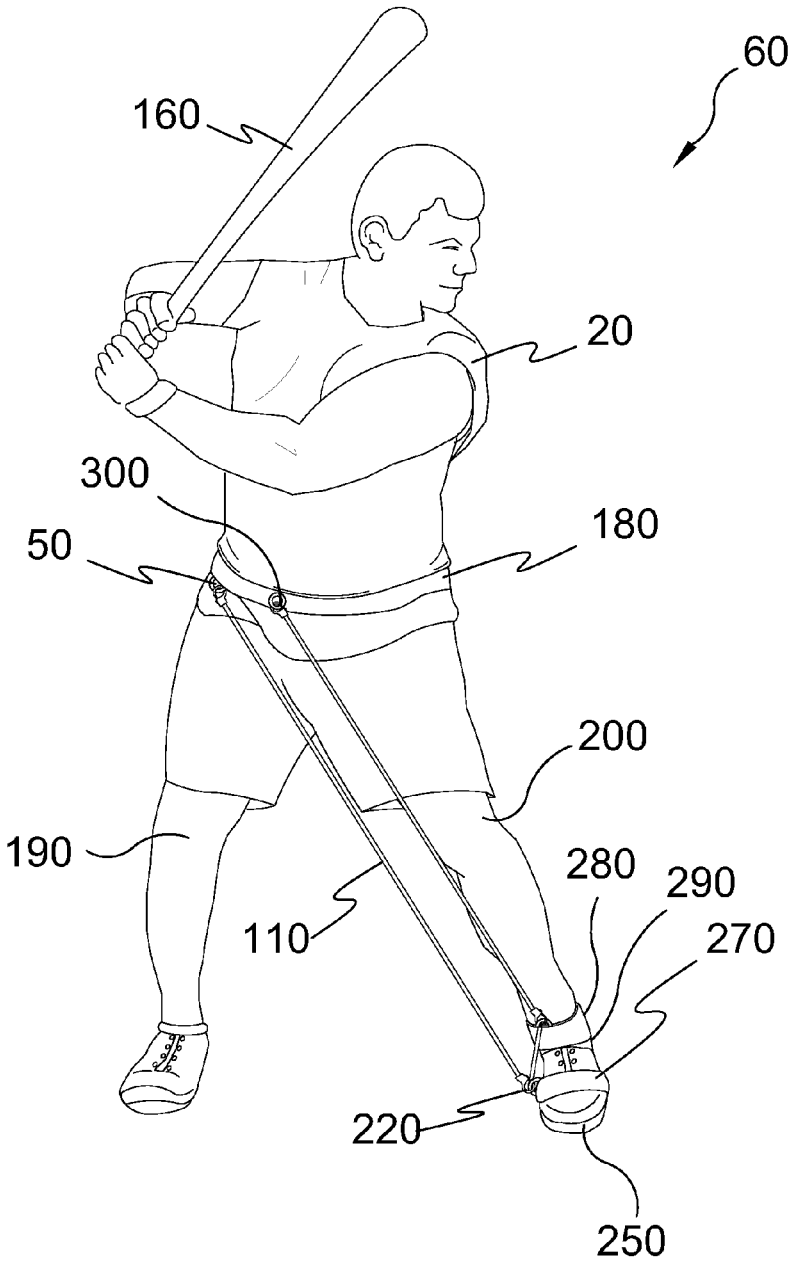

FIG. 3A an illustrative view of the Batter's Belt Stride Trainer of the present invention.

Figure 3B:
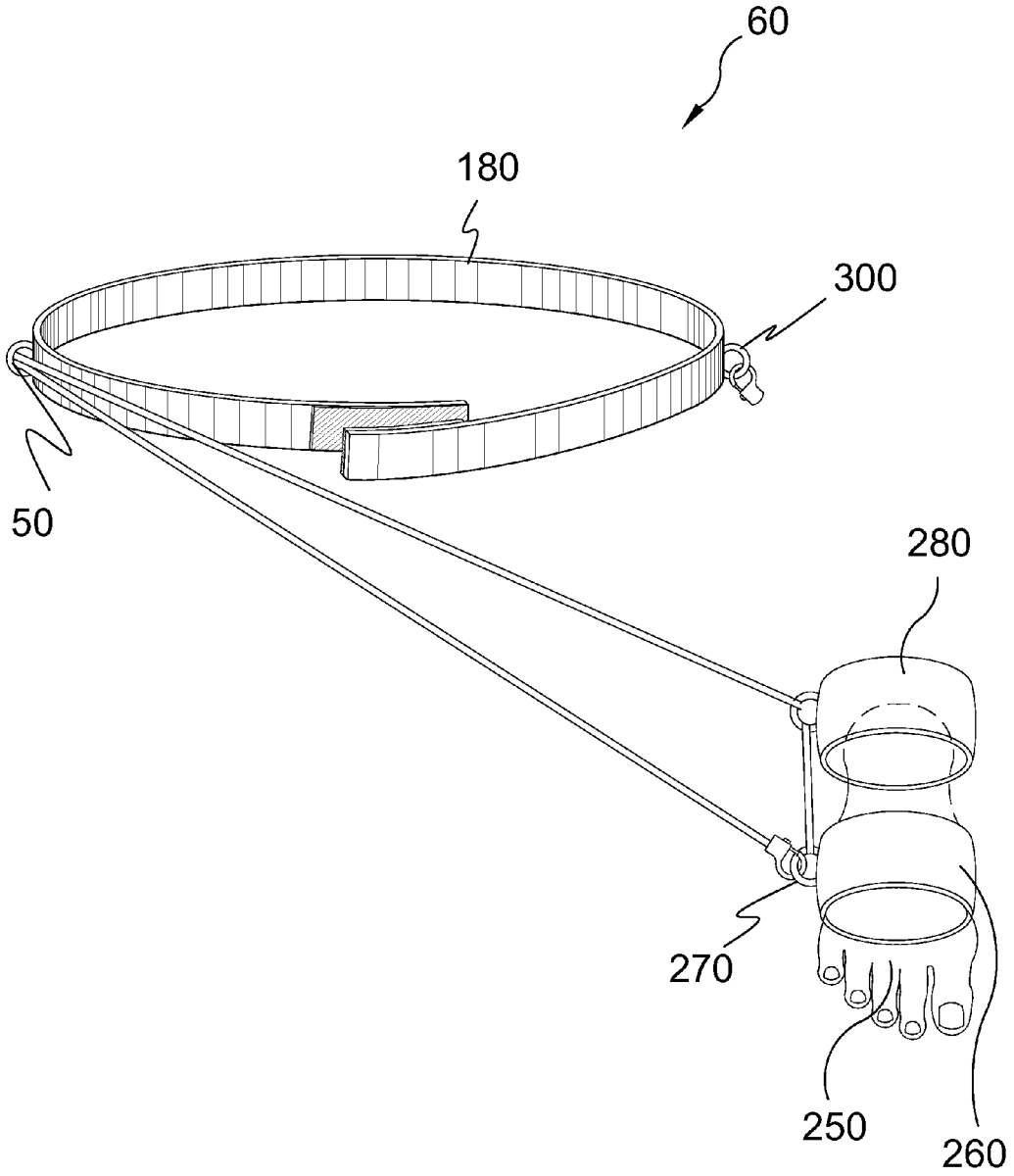

FIG. 3B is a detailed view of the Batter's Belt Stride Trainer of the present invention.

Figure 4A:
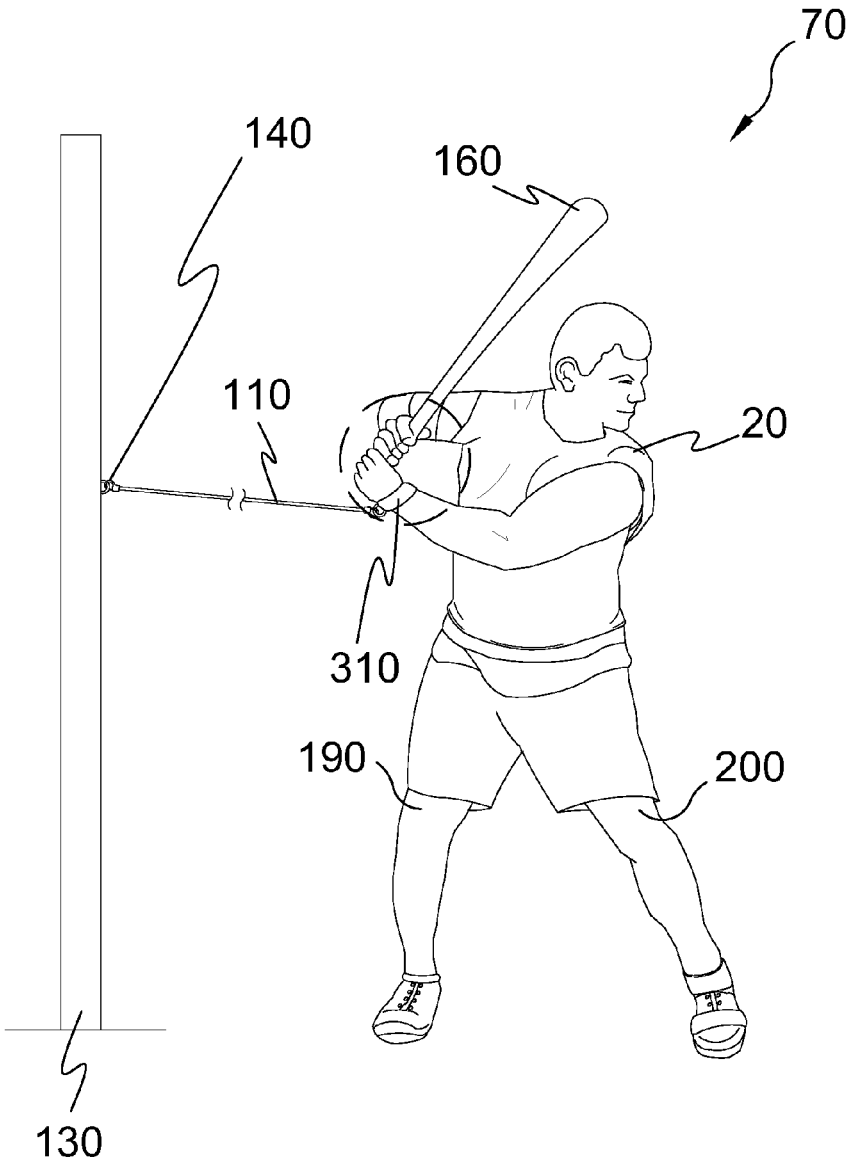

FIG. 4*a* is an illustrative view of the Batter's Wall-Hands Back Trainer of the present invention.

Figure 4B:
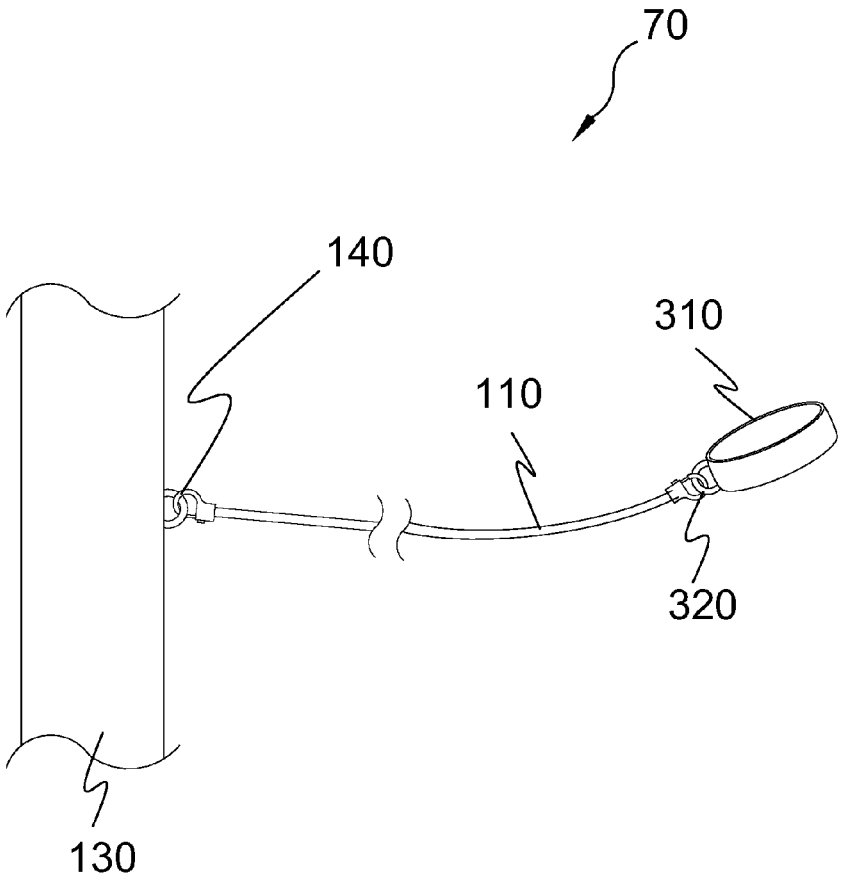

FIG. 4B is a detailed view of the Batter's Wall "hands Back Trainer" of the present invention.

Figure 5A:
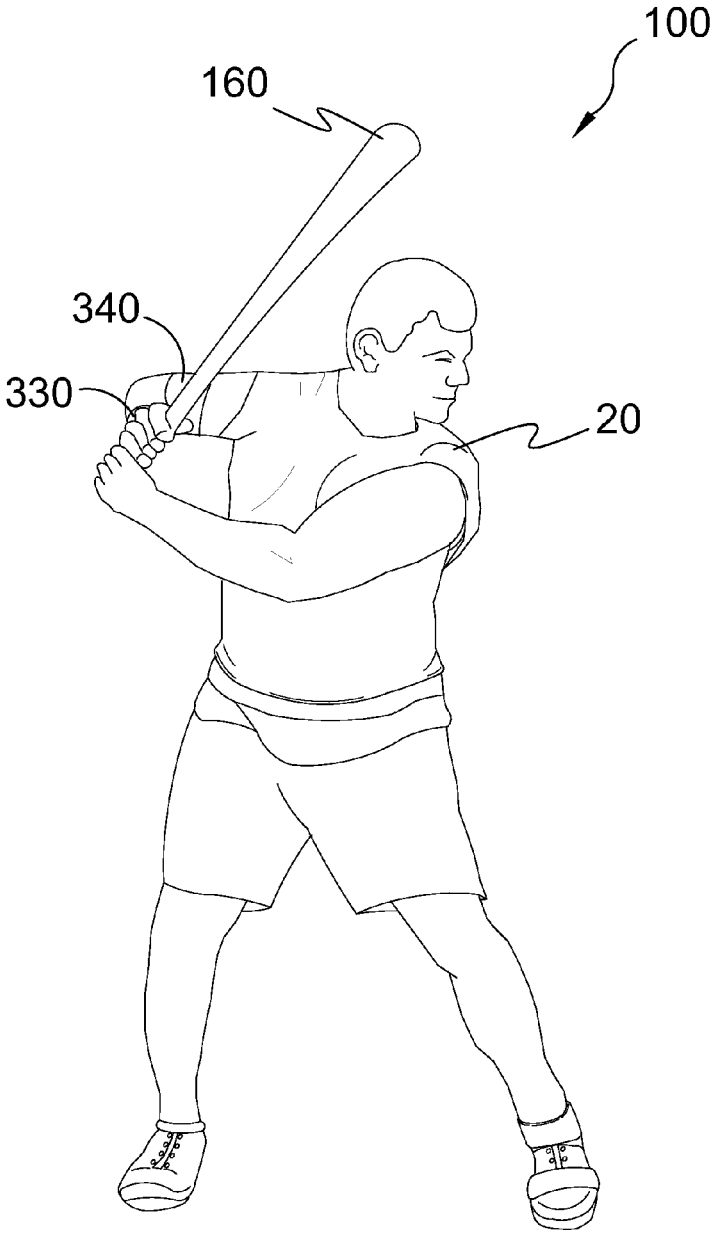

FIG. 5A is an illustrative view of the Baseball-Arm Trainer of the present invention in use.

Figure 1:
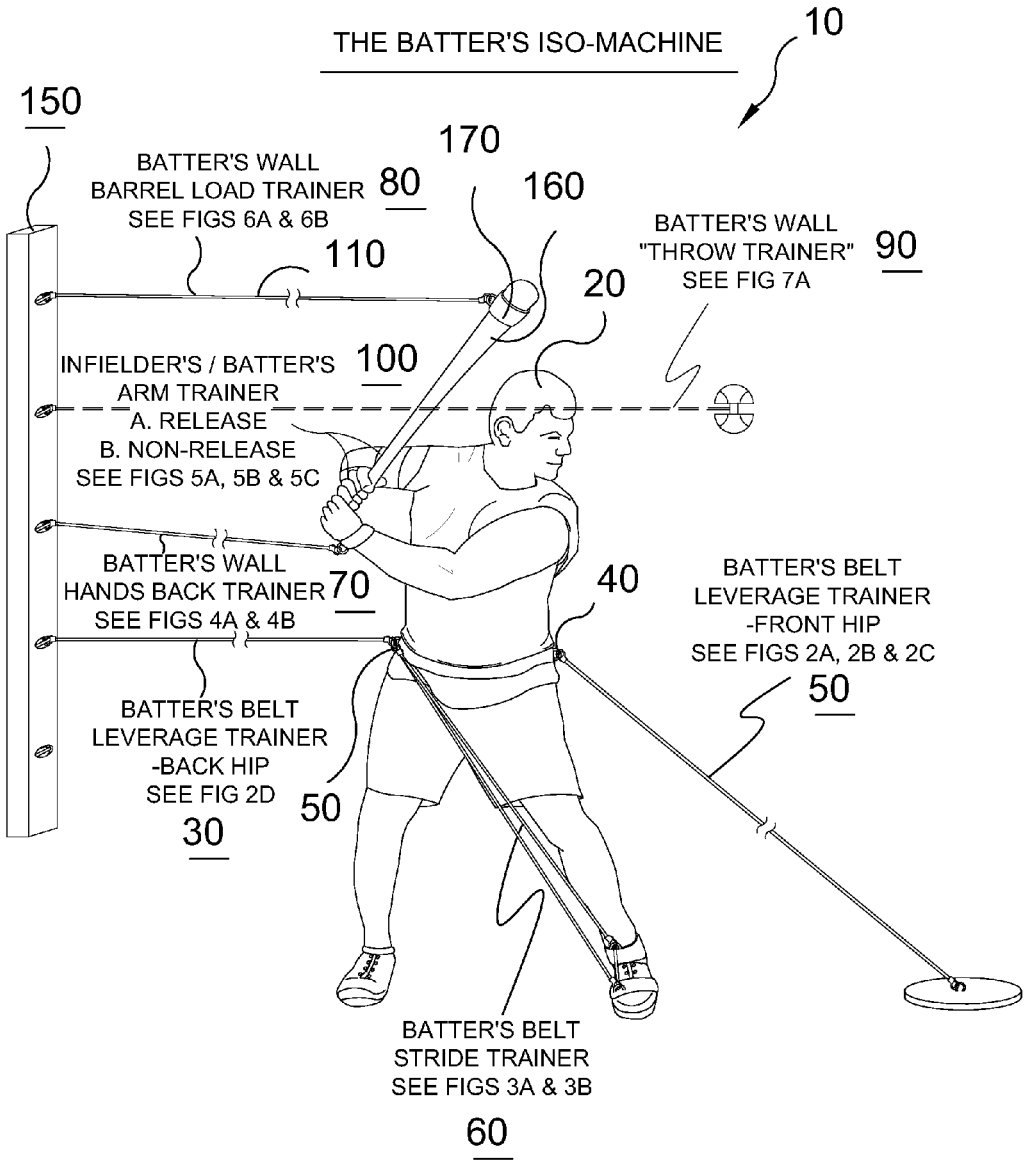
FIG. 1 is an illustrative view of the Batter's Iso-Machine of the present invention.

FIG. 5B1 is a detailed view of the Baseball-Arm Trainer with a non-release type connector.

FIG. 5B2 is a detailed view of the Baseball-Arm Trainer with a release type connector.

Figure 5C:
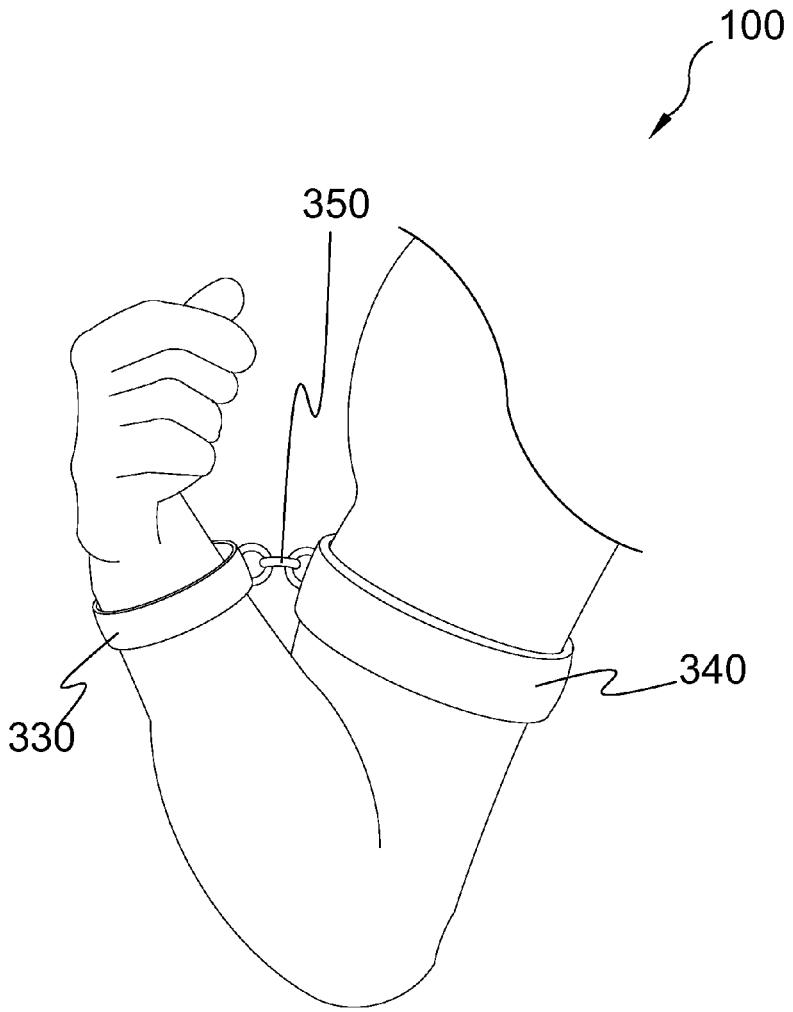

FIG. 5C is an illustrative view of the Baseball-Arm Trainer of the present invention in use.

Figure 5D:
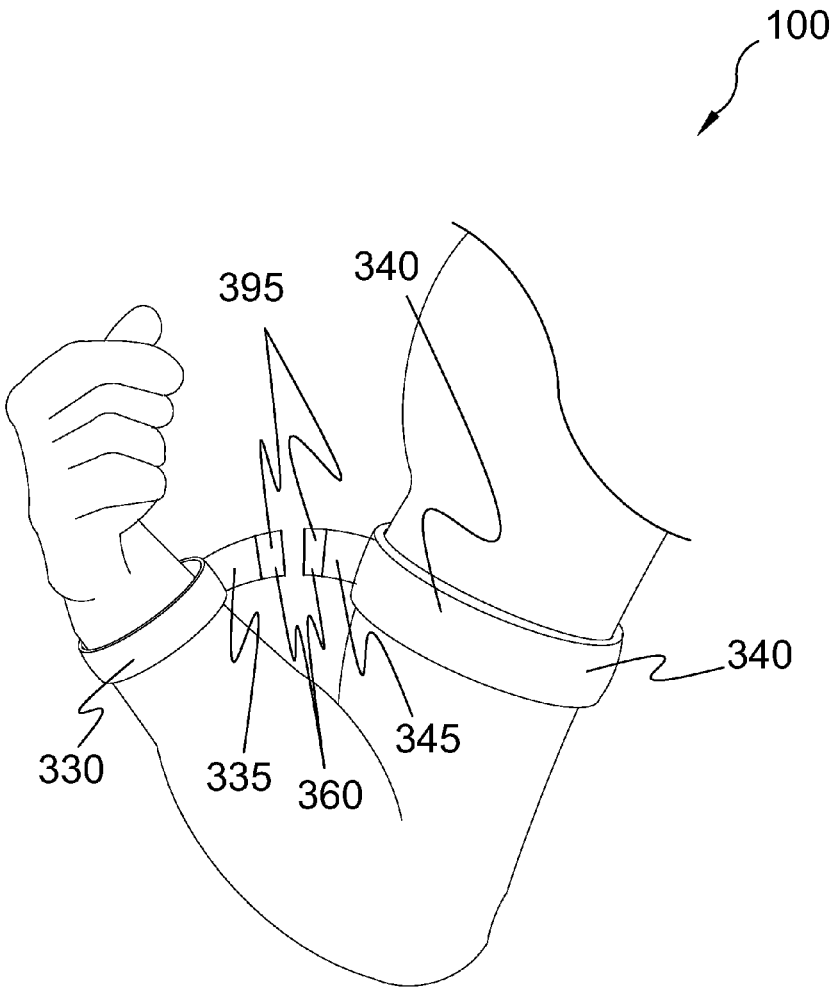

FIG. 5D is an illustrative view of the Baseball-Arm Trainer of the present invention in use.

Figure 6A:
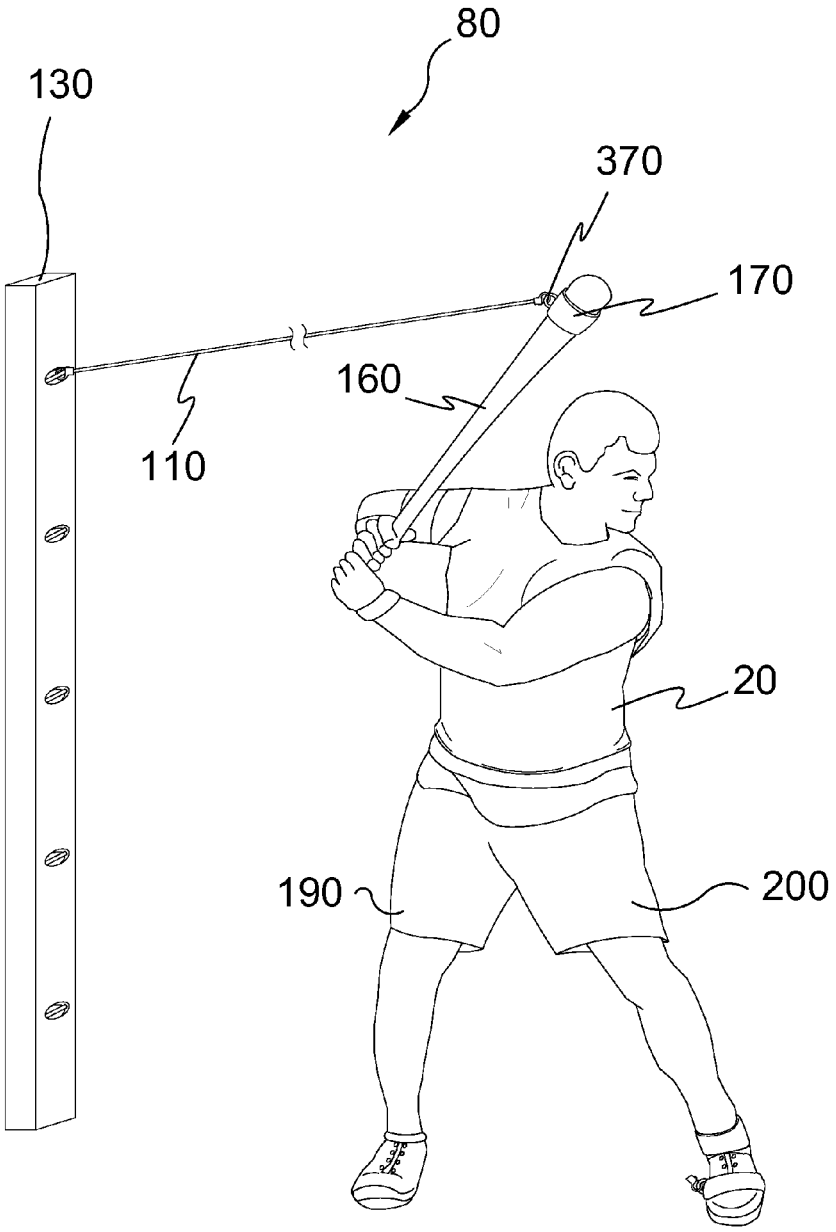

FIG. 6A is an illustrative view of the Barrel Load Trainer of the present invention.

Figure 6B:
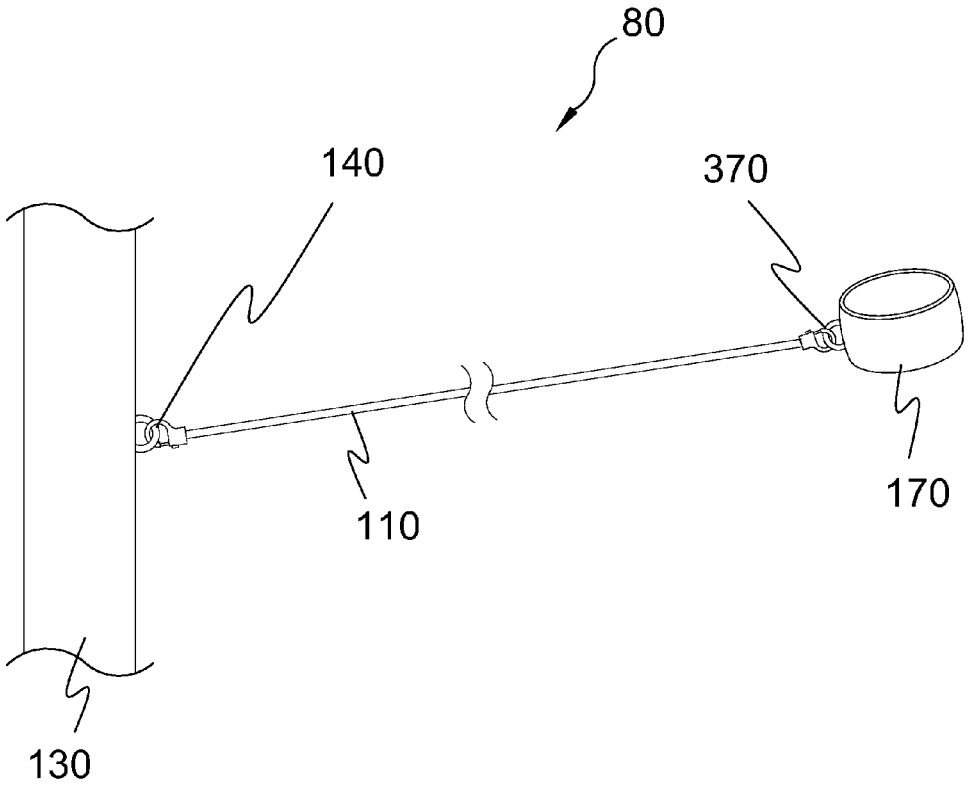

FIG. 6B is a detailed view of the Barrel Load Trainer of the present invention.

Figure 7A:
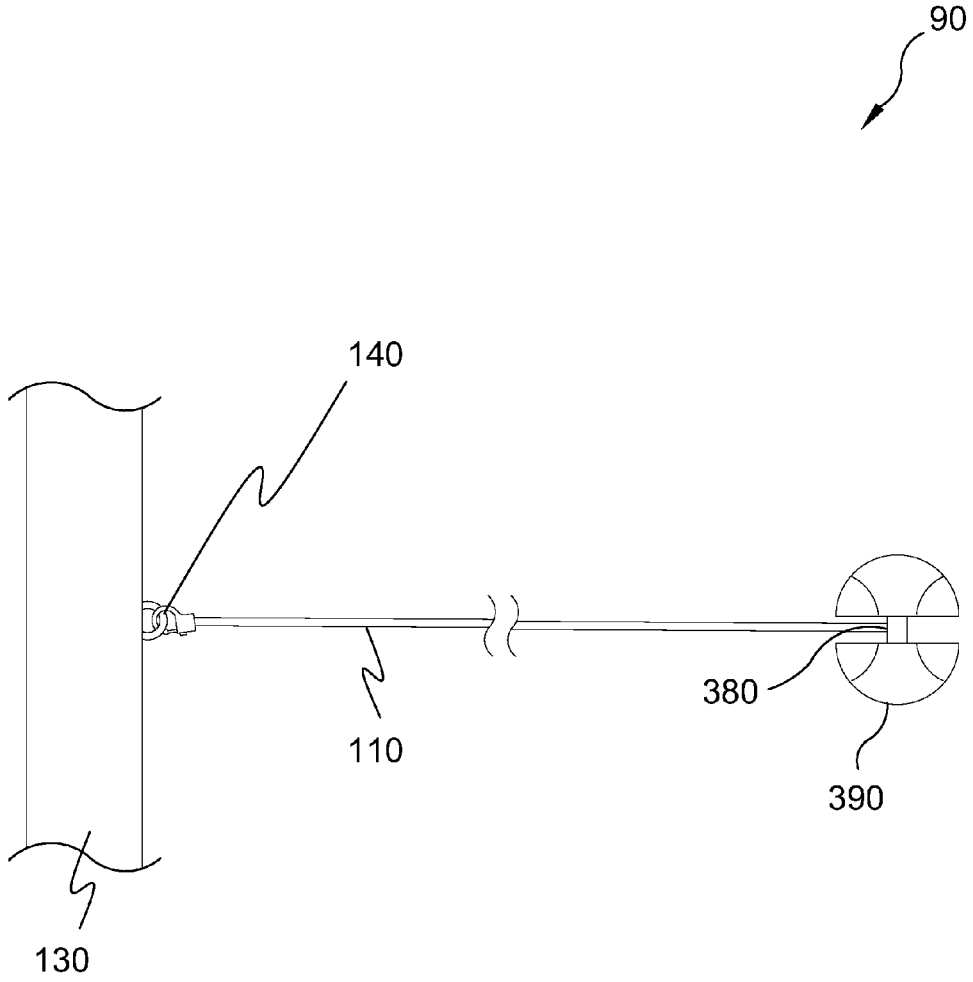

FIG. 7A is a detailed view of the Throw Trainer of the present invention.

10 sports training apparatus
20 user
30 Batter's Belt Leverage Trainer
40 front hip attachment on 30
50 back hip attachment on 30
60 Batter's Belt Stride Trainer
70 Hands Back Trainer
80 Barrel Load Trainer
90 Throw Trainer
100 Baseball-Arm Trainer
110 elastic connector
120 anchor
130 Batter's wall
140 vertically spaced attachment points
150 board
160 bat
170 bat barrel cuff
180 belt strap
190 back leg
200 front leg
210 anchoring device
220 anchor fastener
230 hook and loop type fasteners
240 center of mass drifting forward
250 ball of front foot
260 foot cuff
270 cuff fitting
280 ankle cuff
290 front ankle
300 forward attachment point on 180
310 lead wrist cuff
320 fastener of 310
330 wrist cuff
335 fastener of 330
340 bicep cuff

345 fastener of 340
350 non-release connector
360 release connector
370 fastener of 170
380 ball post
390 ball
395 plastic clip, Velcro®, magnets, snaps, etc

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the Batter's Iso-Machine of the present invention. The Batter's Iso-Machine is a sports training apparatus 10 with batter's wall 150 which isolates various parts of the body that are used by baseball players in the course of a game. Shown is a user 20, for example, a baseball player, and representations of the major exercise groups developed by the present invention. This includes actions such as swinging a baseball bat when attempting to hit a baseball including 1. A. Batter's Belt Leverage Trainer 30, front 40 and back 50 hip attachments, and B. Batter's Belt Stride Trainer 60, 2. A. Batter's Wall Hands Back Trainer 70, B. Batter's Wall Barrel Load Trainer 80, and the action of throwing a baseball with 2 C. Batter's Wall Throw Trainer 90 and 3. A. The Baseball-Arm Trainer 100 with non-release and release variants.

By isolating each part of the body during a baseball swing, the invention maximizes the performance of the parts of the body that are kinetically linked in a sequential manner to all other parts of the body in an effort to maximize the force and power that can be generated, for example, when hitting a baseball. This is accomplished by the use of one or more elastic connectors 110 which connect a specific body part to a relatively stationary object. The relatively stationary object can include, for example, ground anchors 120 shown with the Batter's Belt Leverage Trainer 30, front hip attachment 40, a "Batter's Wall" 130 such as a series of, for example, 5 vertically spaced attachment points 140 such as hooks or small rods attached to a board 150, as used with the Batter's Belt Leverage Trainer 30, the Hands Back Trainer 70, the Barrel Load Trainer 80, the Batter's Wall Throw Trainer 90 or even another body part as with the Batter's Belt Stride Trainer 60 and the Baseball-Arm Trainer 100. With the Barrel Load Trainer 80, the elastic connector 110 connects to the user 20 through a baseball bat 160 held by the user 20, with the bat 160 releasably affixed to the elastic connector 110 by means of a cuff 170 wrapped around the barrel of the bat.

The elastic connector 110 is a generally flexible material such as surgical tubing, resistance bands or bungee cords attached to the hooks/rods 140 on the board 150 and to the hitter or devices used by the hitter such as the bat 160 or, with the use of cuffs or other materials attaching to the elastic connector 110 to control certain movements of the batter's swing and to aid in the development of strength and muscle memory for the hitter. The board will attach easily to any stationary object such as a fence, door, weight or other object.

Figure 2A:
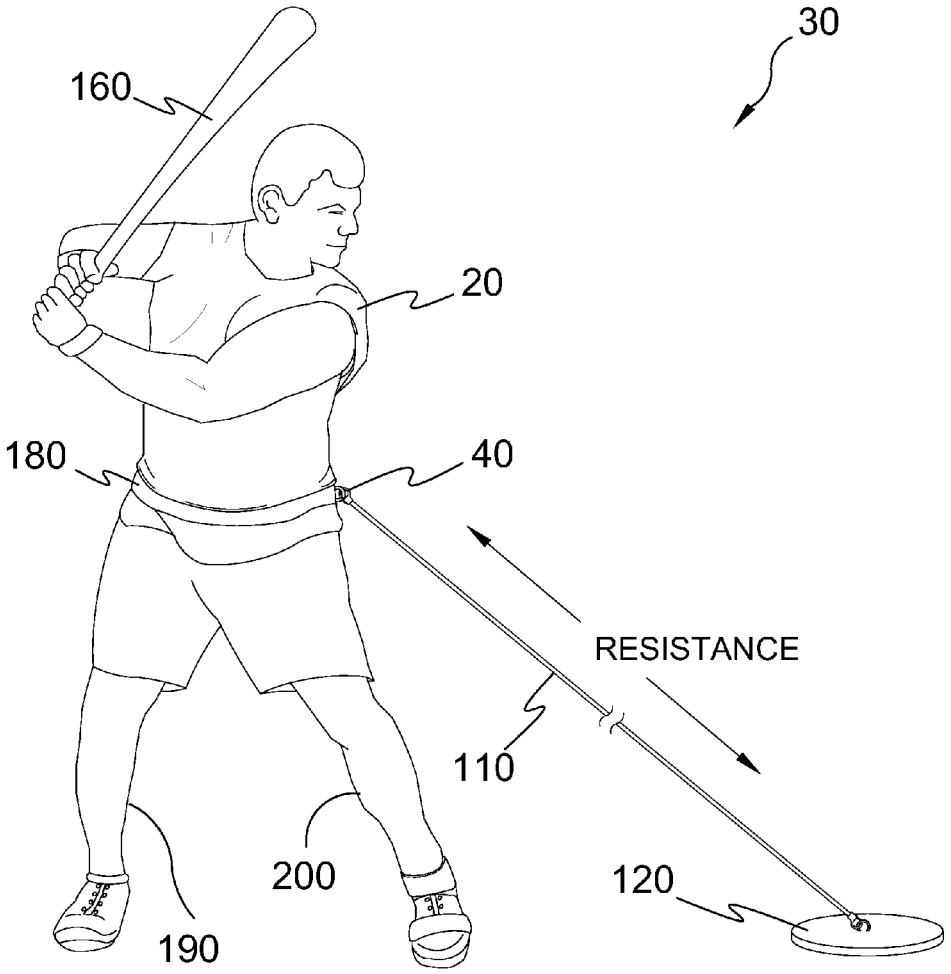
FIG. 2A is an illustrative view of the Batter's Belt Leverage Trainer to anchor.

FIG. 2A is an illustrative view of the Batter's Belt Leverage Trainer 30 including a belt strap 180 which wraps around the waist/hips of the user 20, an attachment point 40 on the forward hip area of the belt strap 180, an elastic connector 110 connecting the forward hip attachment point 40 to the anchor 120. The elasticity, or "pulling force" of the tubing 110 assists the user 20 in abducting the back femur to create proper straight-line "weight shift" from the back leg to the front leg as the batter 20 swings the bat 160. The hitter must resist and not allow the "pulling force" of the tubing to pull the center of mass on top of or over the center of pressure held on the front foot. The Leverage Trainer 30 develops the proper and essential functions of both legs.

Back Leg: The added resistance increase the intensity of the first phase of the back leg, the loading phase, which occurs as the weight is "gathered" into the back side as the stride begins just before the release of the pitch. The back leg 190 must then drive the body weight into and against a "Leveraged" front leg 200 that stabilizes the Center-of-Mass behind the Center-of-Pressure on the front foot. The "pulling force" of the Leverage Trainer assists the hitter in driving off of the backside.

Front Leg: During perhaps the most critical points in the swing, just before and during contact, most if not all of the batter's Center-of-Pressure is held on the front foot and this significant degree of force and energy is controlled and directed by the front leg 200. The added resistance produced by the Leverage Trainer intensifies this force and energy produced and the critical importance of stabilizing the Center-of-Mass behind the front foot becomes a focal point of the hitter. The added resistance of the Leverage Trainer speeds the development of balance, strength and proprioception in the front leg as it continues to work against the ground while holding all or nearly all of the body's Center-of-Pressure during the final phases of the swing. The tubing 110 can also be attached to the rear hip to provide "Resistance" for the back leg abduction that creates "weight-shift". Allowing the batter 20 to work against resistance to abduction and "weight-shift" not only increases strength and balance, but also allows the batter 20 to better feel the proper movement of the back leg 200 as it is loaded and unloaded during the stride.

Figure 2B:
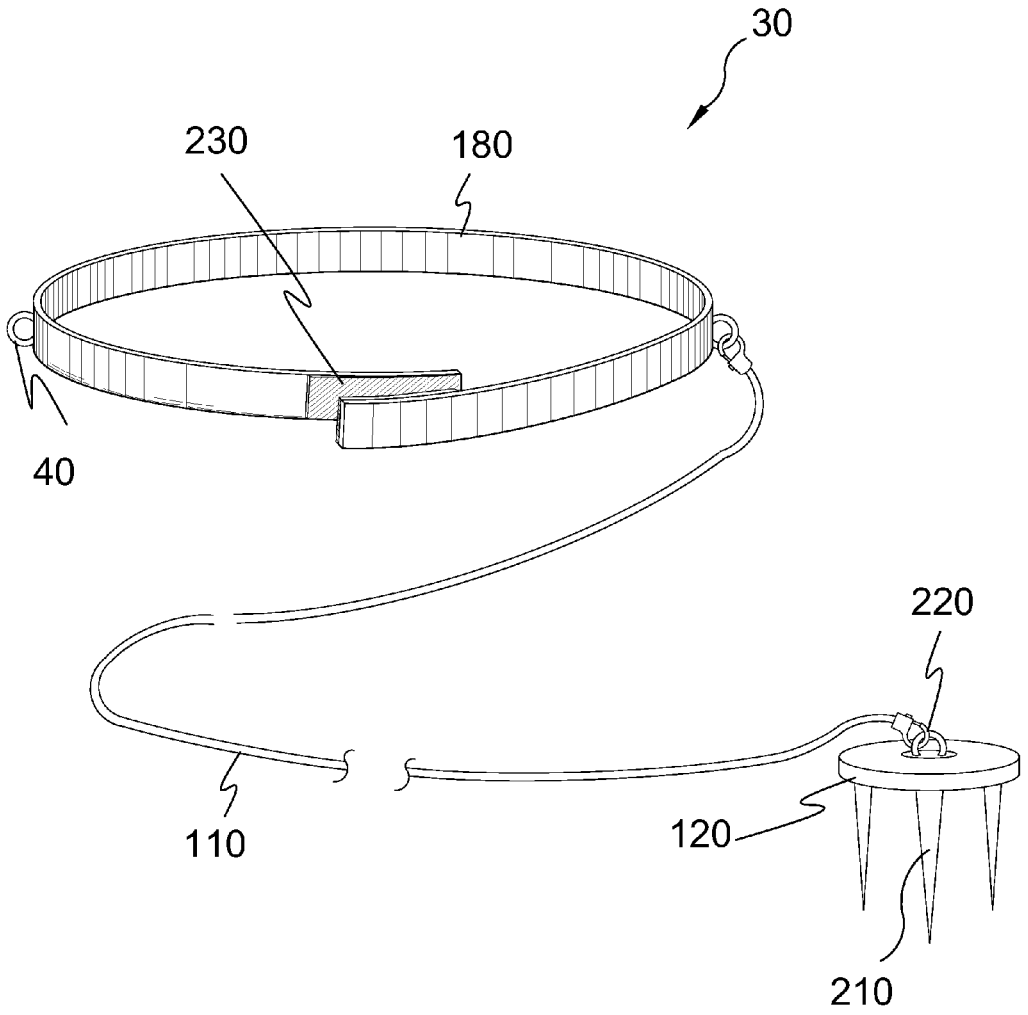
FIG. 2B is a detailed view of Batter's Belt Leverage Trainer of the present invention.

FIG. 2B is a detailed view of Batter's Belt Leverage Trainer 30 of the present invention. Shown is the equipment used for the Batter's Belt Leverage Trainer 30 comprising a waist band, or belt strap 180 tethered to a forward anchor 120 by means of an elastic member 110 whereby the hitter learns to maintain excellent balance when the center of pressure is placed on the front foot as the batter swings. The anchor 120 is shown including an anchoring device 210 which secures to a stationary surface and an anchor fastener 220 to which the elastic member 110 affixes. The elastic member 110 affixes to the belt strap 180 through front hip attachment 40, which can be either fixed or slidably affixed to the belt strap 180. The belt strap 180 can be adjustable, for example, with a buckle or hook and loop type fasteners 230.

Figure 2C:
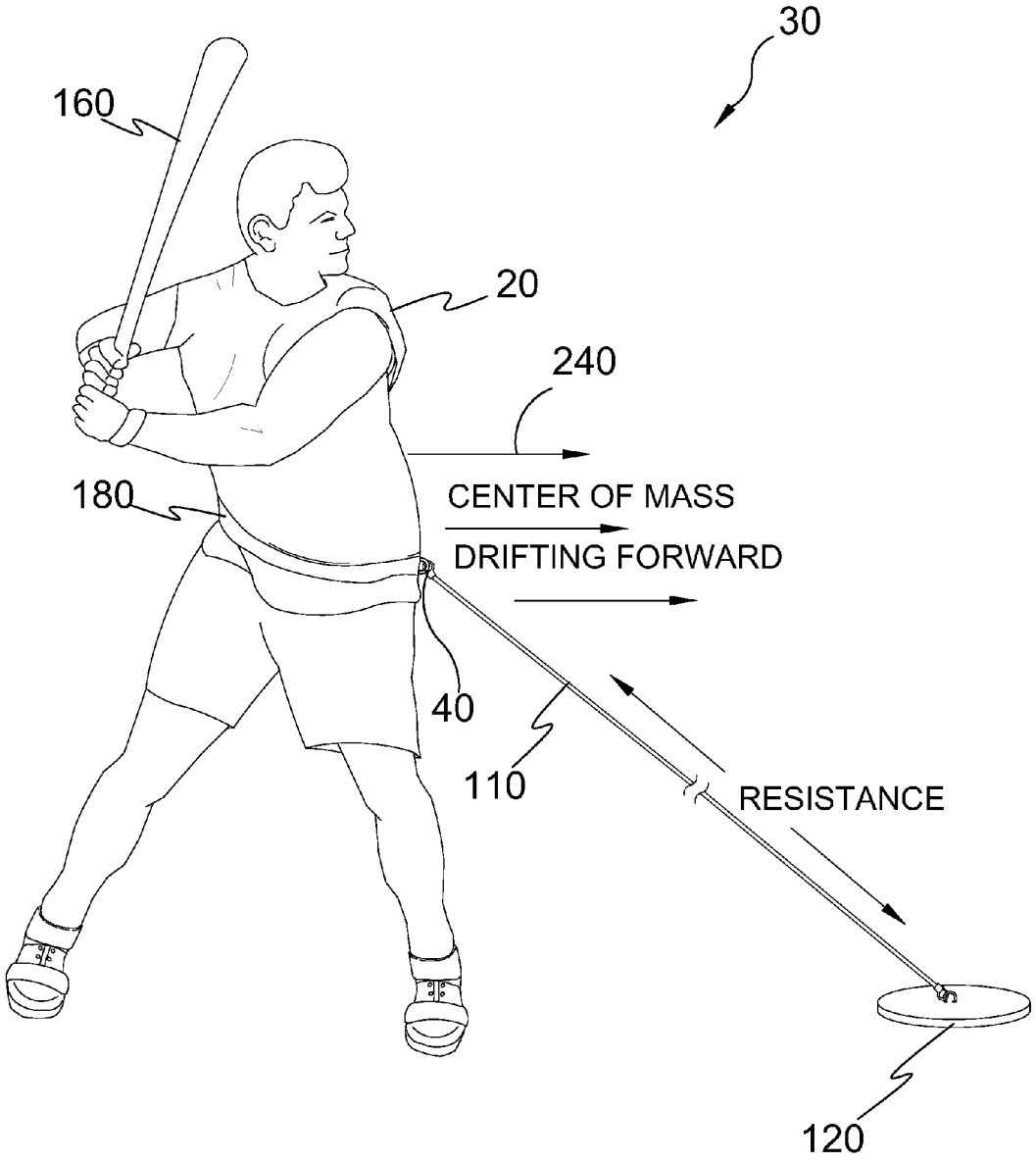
FIG. 2C is an illustrative view of the Batter's Belt Leverage Trainer to anchor.

FIG. 2C is an illustrative view of the Batter's Belt Leverage Trainer 30 of the present invention. Depicted is the elastic member 110 extending from the front hip attachment 40 between the belt strap 180 and the forward anchor 120 pulling the batter 20 forward out of balance. The hitter 20 must resist and not allow the "pulling force" of the tubing 110 to pull the Center-of-Mass on-top-of or over the Center-of-Pressure held on the front foot thereby maintaining excellent balance and resistance to the elastic member 110 preventing the hitter's 20 center of mass drifting forward 240 before and during a swing of the bat 160.

Figure 2D:
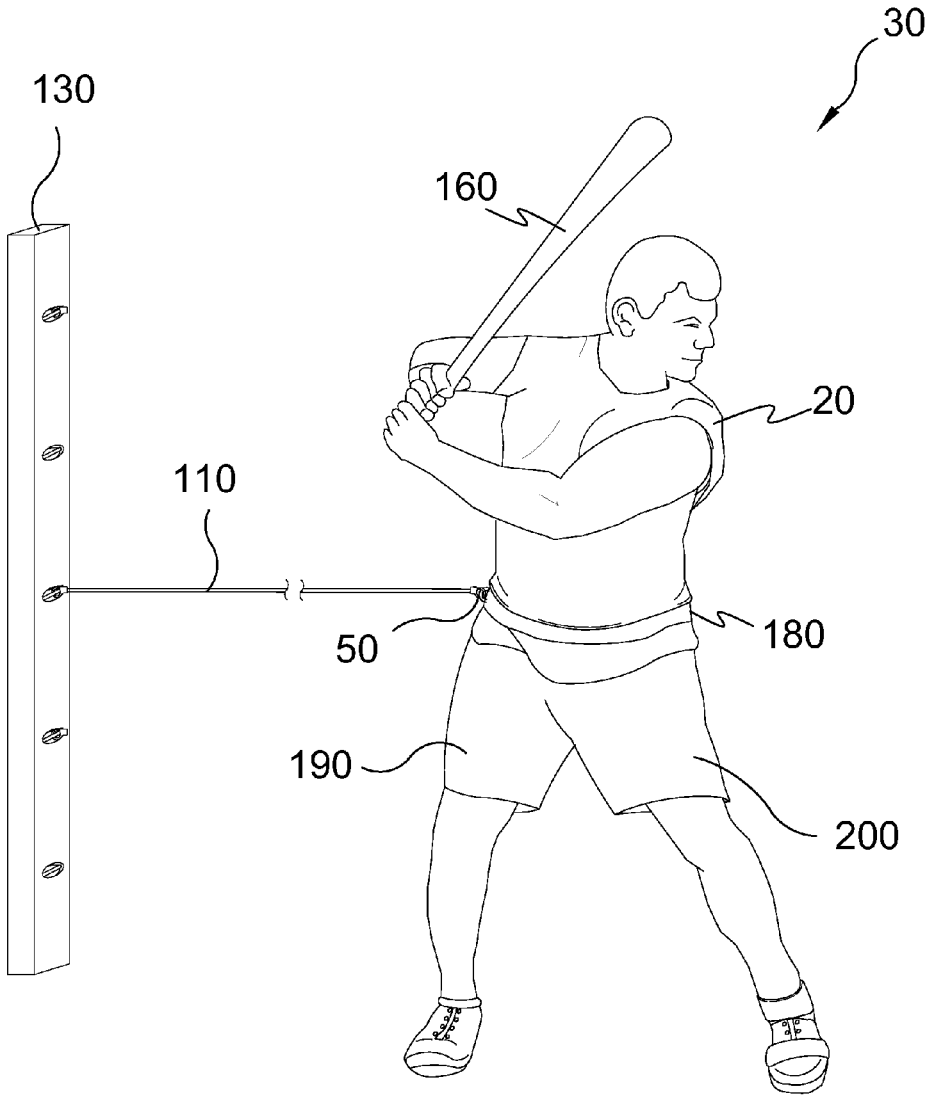
FIG. 2D is an illustrative view of the Batter's Belt Leverage Trainer Back-Hip attachment.

FIG. 2D is an illustrative view of the Batter's Belt Drive Trainer 30 using the back hip attachment 50. The elastic member 110 extends from the back hip attachment 50 connecting the belt strap 180 rearward toward the batter's wall 130, emphasizing the initial weight loading of the back leg 190 at the beginning of the swing just before the push forward and shift of pressure to the front leg 200 as the batter 20 swings the bat 160. The elastic member 110 connects to the batter's wall 130 through one or more vertically spaced attachment points on the batter's wall 130.

FIG. 3A an illustrative view of the Batter's Belt Stride Trainer 60 of the present invention. In use with the Stride Trainer 60, the elastic connector 110 connects to the back hip attachment 50 of the Power-Drive-Belt (belt strap) 180 to the ball of the front foot 250, for example, with a cuff or band or strap 260 fit around the ball of the foot 250 to which the tubing 110 connects, for example, with a cuff fitting 270. The tubing 110 may also connect to a "safety cuff" 280 around the front ankle 290 then from the safety cuff 280 to the cuff fitting or band or strap 270 placed around the ball of the front foot 250. This safety connection will prevent the tubing 110 from striking the batter 20 if the tubing 110 disconnects from the front foot or any any other portion of the system.

This attachment serves a number of purposes: The resistance provided by the tubing 110, assists the hitter 20 in maintaining a closed position of the front foot during the stride preparatory to swinging the bat 160. The resistance provided will not prevent the foot from externally rotating, but it does assist the hitter in "staying closed" with the front foot both physically/mentally.

Excessive opening of the front foot (a landing position of >45 degrees) is a very common flaw seen in young hitters and is often coupled with "stepping out" in fear of the pitched ball. This flaw directs energy away from the contact point and is a serious plate management issue because pitches on the outer part of the plate become quite problematic.

Excessive opening of the front foot (a landing position of >45 degrees) is also quite common among more experienced hitters. Excessive opening of the front foot can work its way up to the femur, into the hip, torso and shoulder segment. This creates a "Power-Leak" because these segments are expending potential energy prematurely.

A Closed Front-Foot also puts the Front leg in a better position to "block" and "transfer" the momentum created by the "shift" of the Back leg. This "closed" position creates a more rapid deceleration of the body's Center-of-Mass, which results in more force created to power rotation throughout the rest of the swing. Landing "open" puts the knee in a position to flex or bend excessively which dissipates force and wastes energy that should have been transferred up the Kinetic Chain.

A Closed Front-Foot position also assists the batter in directing the force of the shift in a straight line. This is important for power and plate management. Excessive opening of the front foot (a landing position of >45 degrees) will often result in the premature and excessive rotation of other body segments. This flaw will direct the energy in a less-than-focused position to the batter's pull-side. "Flying open" also creates plate-management issues in dealing with off-speed pitches and balls on the outer half of the plate.

The Stride-Trainer attachment point 50 at the back hip which is a permanent and fixed attachment provides the batter 20 with the feeling that the front foot is being "pulled-up" by the backside. This sensation of having the back leg 190 in control of the "footwork" is a key element of our training system.

The positioning of the tubing 110 allows for the front foot to be "pulled-up" as the back leg 190 "loads" to begin the stride, allowing the back leg 190 to control the "footwork' promotes proper loading of the back leg 190 and ensures that the back leg 190 completes the "press" or 'shift' prior to the front heel landing in completion of the stride.

By taking control of the footwork/stride away from the front leg 200 we can reduce much of the unwanted activity of the front leg 200 that occurs while the front foot is off the ground. We want back leg 190 control.

Over-striding is another common flaw related to an over-active front leg 200. This is caused when the batter 20 over-reaches with the front foot, causing excessive abduction at the front hip socket. The resistance provided by the tubing 110 will not prevent excessive reaching/abduction by the front leg 200, but it helps the batter 20 to put the back leg 190 in control and reduce unwanted activity by the front leg 200 during the stride.

FIG. 3B is a detailed view of the waist to foot restraint, or Belt Stride Trainer 60 of the present invention. Shown is the belt 180, which attaches around the hitter's waist, with elastic member 110 extending between the back hip attachment 50 on the belt 180 and the front foot cuff or band or strap 260 around the ball of the hitter's 20 foot. Optionally, the elastic member 110 can further extend from the front foot cuff or band or strap 260 to a foot/ankle (safety) cuff 280. The restraint is used to assist the batter with landing the front foot as square as possible providing the batter with a strong block or wall with the landing of the front foot sending greater forces up through the body. In use with the Stride Trainer 60, the elastic connector 110 connects to the back hip attachment 50 of the Power-Drive-Belt (belt strap) 180 to the ball of the front foot 250, for example, with a cuff or band or strap 260 fit around the ball of the foot 250 to which the tubing 110 connects, for example, with a cuff or band or strap fitting 270. The tubing 110 may also connect to a "safety cuff" 280 around the front ankle 290 then from the safety cuff 280 to the cuff or band or strap fitting 270 placed around the ball of the front foot 250. This safety connection will prevent the tubing 110 from striking the batter 20 if the tubing 110 disconnects from the front foot or any any other portion of the system.

FIG. 4A is an illustrative view of the Batter's Wall Hands Back Trainer 70 of the present invention. The Hands-Back-Trainer 70 utilizes a cuff 310 around the lead wrist that is attached to tubing 110 which connects to a stable attachment point 140 on the Batter's Wall 130 or other stationary object at shoulder height, directly behind the hitter 20. The Hands-Back-Trainer 70 allows the batter 20 to complete his stride and slot his elbow while assisting the hitter in keeping the "hands back" throughout these phases of the swing of the bat 160.

The Hands-Back-Trainer 70 is not to be utilized with the full-swing. The batter 20 should use the Hands-Back-Trainer 70 with a "live-take" mentality—either working against a live pitcher, actively taking pitches or mentally simulating the pitch and performing a "live-take".

It is important to note that the batter strides on every pitch, regardless if the batter swings or not. This means that, as part of the stride, he will load his weight onto the back leg 190, and shift that weight against the front leg 200 on every pitch. Immediately after the back leg 190 begins to abduct to "press" or "shift" that weight against the front leg 200 the back elbow will begin to "slot".

When utilizing the Hands-Back-Trainer 70, the batter 20 is to focus on perfecting the actions of the back leg 190 to control the footwork/stride and perfect the "loading" and "slotting" of the back elbow while allowing the Hands-Back-Trainer 70 to assist in keeping the hands back throughout these phases of the swing.

Keeping the hands back throughout these phases of the swing is vital to the proper sequencing of the kinetic chain. The larger body segments must be allowed to do their work before involvement of the hands. This will maximize energy creation and transfer to the bat-head. Keeping the hands back throughout these phases also enhances "plate-management" by allowing the batter more time to assess the speed and location of the pitch before committing his hands to swing.

FIG. 4B is a detailed view of the Batter's Wall "Hands Back Trainer" 70 of the present invention. Shown is the equipment comprising an elastic member 110 attached between a fastener 320 on the lead wrist cuff 310 on the hitter's wrist and a wall anchor or other anchor 140 to control certain movements of the batter's swing and to aid in the development of muscle memory for the hitter. The anchor can be attached to any stationary structure, for example, a Batter's wall 130, or a fence, door or other stationary structure. The Hands-Back-Trainer 70 utilizes a cuff 310 around the lead wrist that is attached to tubing 110 which connects to a stable attachment point 140 on the Batter's Wall 130 at shoulder height, directly behind the hitter. The Hands-Back-Trainer 70 allows the batter to complete his stride and slot his elbow while assisting the hitter in keeping the "hands back" throughout these phases of the swing.

FIG. 5A is an illustrative view of the Baseball-Arm Trainer 100 of the present invention. Shown is the invention in use by a batter 20 swinging a baseball bat 160, and functions to prevent or delay (depending on what type of connector between the two cuffs is selected) extension of the back elbow.

As shown in FIG. 5B, for batting, the Baseball-Arm Trainer 100 consists of two cuffs connected by a short piece of rigid or flexible connector material, for example, tubing or other material such as plastic, metal, magnet, Velcro® or other. One cuff 330 having fastener 335 is attached at the trailing wrist and the other cuff 340 having fastener 345 is attached just above the trailing bicep, both on the rearmost, or trailing, arm. The purpose of the device is to prevent the hitter from prematurely extending his back arm or elbow during the leading phase of the trailing arm or during the slotting phase of the back elbow. Premature extension of the back arm or elbow would cause the bat angle to drop too soon causing long, circular and inefficient swings. It also aids muscle memory for proper tucking of the back elbow and keeping the bat vertical while tucking.

The trailing arm cuff connector can be a "non-release" type connector 350, such as elastic, rigid plastic, metal, magnetic, Velcro®, or similar device, or it can be a releasable connector 360, such as plastic clip, Velcro®, magnetic or similar device. With the non-release attachment 350 selected, the batter should work on the proper movements of the trailing arm including lifting (abducting) and internally rotating the bone in the upper arm (humerus) during the loading phase and lowering (adducting) and externally rotating the bone in the upper arm (humerus) as the back elbow slots. With the non-release 350 attachment selected the "Baseball-Arm" Trainer 100 is not to be utilized with the full swing. The batter 20 should use the "Baseball-Arm" Trainer 100 with the "live-take" mentality—either working against a live pitcher, actively taking pitches or mentally simulating the pitch and performing a "live-take".

The "Baseball-Arm" Trainer 100 restricts movement at the elbow joint and forces focus onto the shoulder joint. The action of loading and the initial-stages of unloading the trailing arm should take place solely at the shoulder joint and not at the other two joints of the arm: the wrist and elbow. Premature extension of the trailing elbow during the loading phase of the trailing arm or during the slotting phase creates a long swing, a heavy bat (by increasing rotational inertia) and reduces potential energy (by performing a less than optimal trailing arm loading action).

Learning to "lift and turn the bone" without premature extension of the trailing elbow is one of the most important aspects of an elite swing and has been, to my knowledge, completely omitted by prior instruction. The Baseball-Arm" Trainer 100 rapidly increases the batter's awareness of the bone's movement resulting in a much more efficient pattern in reduced time.

With the release attachment 360 selected, the batter can take full cuts in the "Baseball-Arm" Trainer 100. The release attachment 360 provides light resistance to assist the batter in "lifting and turning the bone" without premature extension of the back elbow, however, the connection between the cuffs will release and produce a sound or other sensation or signal under significant force. This allows the hitter to take live cuts and receive immediate feedback as to the timing of the extension of his back elbow. Elbow extension should be delayed until just before contact, therefore the sound or other sensation or signal signifying extension should occur close to contact. If the connection is detached prematurely during the trailing arm loading phase or as the elbow slots, the signal will alert the hitter well before contact, alerting the batter that his trailing arm pattern was incorrect.

For throwing: The "Baseball-Arm" Trainer 100 is an important device for infielders and catchers. The "Baseball-Arm" Trainer 100 consists of two cuffs connected by a short piece of tubing. One cuff 330 is attached at the wrist and the other cuff 340 is attached just above the bicep on the throwing arm of the same arm. The device functions to prevent or delay (depending on what type of connector between the two cuffs is selected) extension of the throwing elbow.

With the non-release attachment 350 selected, the player should work on the proper movements of the throwing arm including lifting (abducting) and internally rotating the bone in the upper arm (humerus) and externally rotating the bone in the upper arm (humerus) as the back elbow slots. With the non-release attachment 350 selected the "Baseball-Arm" Trainer 100 is not to be utilized with the full throw.

With the Non-Release attachment 350 selected, the player should use the "Baseball-Arm" Trainer 100 to learn how to properly take the ball out of the glove during the stride phase by lifting and "turning the bone" to get the ball out of the glove as well as externally rotating the upper arm (humerus) to get the ball back into the lag position as the hips then torso is driven "open towards target.

The "Baseball-Arm" Trainer 100 with the Non-Release attachment 350 selected, can also be used in conjunction with other resistance devices to strengthen the Internal and External Rotators as well as the Abductors and Adductors of the shoulder joint.

High level infielders and catchers do not increase the degree of extension at the throwing elbow until just before release. The elbow is flexed as the ball is gripped in the glove, the elbow remains flexed as the humerus lifts (abducts) and turns (internally rotates) to take the ball out of the glove, and it continues to resist extension as the humerus externally rotates to "lay the ball back" before release. Only as the ball begins to spring forward do we see increasing extension in the throwing elbow.

With the Release attachment 360 selected, the thrower can make full throws with the "Baseball-Arm" Trainer 100. The Release attachment 360 provides light resistance to assist the thrower in "lifting and turning the bone" without premature extension of the back elbow, however, the connection between the cuffs 330, 340 will release and produce a sound under significant force. This allows the thrower to make full throws and receive immediate feedback as to the timing of the extension of his back elbow. Elbow extension should be delayed until just before release, therefore the sound signifying extension should occur close to release. If the connection is detached prematurely as the ball is taken out of the glove or as the humerus externally rotates to "lay the ball back" the signal will alert the thrower well before release, alerting the thrower that his throwing arm pattern is incorrect.

For the non-release attachment 350, the connecting member can be made of any suitably rigid or flexible material, for example, elastic, rigid plastic, magnetic, hook and loop fastener and other material. For the release attachment 360, the connecting member can be made connected by any suitable means, for example, magnetic, hook and loop fastener and other releasable fasteners.

FIG. 5C is an illustrative view of the Baseball-Arm Trainer 100 of the present invention in use. Shown are two cuffs attached to one another by an elastic, rigid plastic, magnet, Velcro®, or other member 350, 360 with one cuff 330 attached to the hitter's wrist on hitter's back arm and the second cuff 340 attached to the hitter's humerus just below the hitter's back shoulder. The purpose of this device is to prevent the hitter from extending his back arm or elbow from prematurely extending during the loading phase of the trailing arm or during the slotting phase of the back elbow that would cause the bat angle to drop too soon causing long, circular and inefficient swings. It also aids muscle memory for proper tucking of the back elbow and keeping the bat vertical while tucking.

FIG. 5D is an illustrative view of the Baseball-Arm Trainer 100 of the present invention in use. The two cuffs having release attachment 360 that are attached to one another by an elastic, rigid plastic, magnet, Velcro®, or other member 395 with one cuff 330 attached to the hitter's wrist on hitter's back arm and the second cuff 340 attached to the hitter's humerus just below the hitter's back shoulder. With the Release attachment 360 selected, the thrower can make full throws in the "Baseball-Arm" Trainer 100. The Release attachment 360 provides light resistance to assist the thrower in "lifting and turning the bone" without premature extension of the back elbow, however, the connection between the cuffs 330, 340 will release and produce a sound under significant force.

FIG. 6A is an illustrative view of the Batter's Wall "Barrel Load Trainer" 80 of the present invention. The Barrel Load Trainer 80 utilizes an attachment point 370 to the bat 160 to connect tubing 110 to a stable attachment point 140 at approximately barrel height, directly behind the hitter 20. The attachment point 140 is preferably affixed to a Batter's wall 130. A cuff 170 which affixes around the barrel of the bat 160 can be include the attachment point 370 to the bat. The Barrel Load Trainer 80 allows the batter 20 to complete his stride and slot his elbow while producing resistance on the barrel. This resistance pulls the barrel in the opposite direction that the barrel should be moving during this phase of the swing and forces the batter 20 to work against this resistance. Allowing the batter 20 to work against resistance will strengthen the top hand and forearm and enhance the "feel" of the proper position of the barrel throughout these phases of the swing.

The Barrel Load Trainer 80 is not to be utilized with the full-swing. The batter 20 should use the Barrel Load Trainer 80 with a "live-take" mentality—either working against a live pitcher, actively taking pitches or mentally simulating the pitch and performing a "live-take".

It is important to note that the batter 20 strides on every pitch, regardless if the batter swings or not. This means that, as part of the stride, he will load his weight onto the back leg 190, and shift that weight against the front leg 200 on every pitch. Immediately after the back leg 190 begins to abduct to "press" or "shift" that weight against the front leg 200 the back elbow will begin to "slot".

When utilizing the Barrel Load Trainer 80, the batter 20 is to focus on perfecting the actions of the back leg 190 to control the footwork/stride and perfect the "loading" and "slotting" of the back elbow while working against the resistance of the Barrel Load Trainer 80 to increase strength in the top hand and forearm and enhance the "feel" of the proper position of the barrel throughout these phases of the swing.

The batter 20 should work to prevent excessive "flattening" of the bat 160 during the loading and slotting of the back arm. This "flattening" most often occurs as a result of excessive supination (palm-up) of the top hand as the back-elbow slots. This flaw moves the barrel away from a "stacked" (stacked: Bat's Center-of-Mass aligned over the pivot point reduces Rotational Inertia) position over the hands increasing the "weight" (Rotational Inertia) of the bat. This makes the bat 160 more difficult to control and accelerate. It also forces premature extension at the back elbow which creates a "long-swing" and additional rotational inertia (weight) on the bat 160. The Barrel Load Trainer 80 asks the hitter 20 to resist this palm-up position (supination) throughout the stride-phase (loading and unloading of the back leg 190) and the loading and slotting of the back arm.

FIG. 6B is a detailed view of the Barrel Load Trainer 80 of the present invention. The Barrel Load Trainer 80 utilizes an attachment point 370 on the bat barrel cuff 170 to connect tubing 110 to a stable attachment point 140 at barrel height, directly behind the hitter. A cuff 170 or some other material or device can be used as the attachment point to the bat. The stable attachment point 140 can be attached to any stationary structure, for example, a Batter's wall 130, or a fence, door or other stationary structure.

FIG. 7A is a detailed view of the Throw Trainer 90 of the present invention. The Throw Trainer 90 comprises an elastic member 110 having a fastener 140 on one end for attachment to the Batter's wall 130 and a ball 390, such as a baseball or tennis ball having post 380 extending therethrough for attachment of the elastic member.

The device functions to simulate the proper action of taking the baseball 390 out of the glove early in the throwing motion and having the infield/catcher work on the proper movements of the back arm including lifting (abducting) and internally rotating the bone in the upper arm (humerus) during the stride phase of the throw and externally rotating the bone in the upper arm (humerus) as the back elbow slots.

The Batter's Wall "Throw Trainer" 90 restricts movement at the elbow joint and forces focus onto the shoulder joint. The Batter's Wall "Throw Trainer" 90 rapidly increases the batter's awareness of the bone's movement resulting in a much more efficient pattern in reduced time. The device functions to prevent or delay extension of the trailing elbow.

The device helps teach the infielder/catcher how to properly take the ball out of the glove during the stride phase by lifting and "turning the bone" to get the ball out of the glove, as well as, externally rotating the upper arm (humerus) to get the ball back into the lag position as the hips then torso are driven "open towards the target".

The device functions to strengthen the internal and external rotators as well as the abductors and adductors of the shoulder joint.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method for training a baseball batter using a batter's arm trainer having first and second cuffs, the method including the steps:

a) placing said first cuff on a wrist of a batter's trailing arm, said first cuff having a first fastening member secured thereto;

b) placing said second cuff on a bicep of the batter's trailing arm, said second cuff having a second fastening member secured thereto; and c) using a breakaway connecting member for joining said first and second fastening members of said first and second cuffs so that said cuffs are virtually adjacent to each other;

wherein said breakaway connecting member provides light resistance when in use, and releases under significant force, producing a signal which provides immediate feedback to the batter, that a pattern of the trailing arm is incorrect.

2. The method of claim 1 in which said fastening members are selected from the group consisting of elastic, rigid plastic, magnet, and hook and loop connector plastic and metal.

3. The method of claim 1 in which said breakaway connecting member comprises said first and second fastening portions overlapping with facing sides thereof having mating hook and loop fastening surfaces.

4. A method for training a baseball player using an infielder's or catcher's arm trainer having first and second cuffs, the method including the steps of:

a) placing said first cuff on a wrist of a user's throwing arm, said first cuff having a first fastening member secured thereto;

b) placing said second cuff on a bicep of a user's throwing arm, said first cuff having a second fastening member secured thereto; and c) using a breakaway connecting member for joining said first and second fastening members of said first and second cuffs so that said cuffs are virtually adjacent to each other;

wherein said breakaway connecting member provides light resistance when in use, and releases under significant force, producing a signal which provides immediate feedback to the user, that a pattern of the throwing arm is incorrect.

5. The method of claim 4 in which said breakaway connecting member comprises said first and second fastening portions overlapping with facing sides thereof having mating hook and loop surfaces.

* * * * *